US006481707B2

(12) United States Patent
Matsuo et al.

(10) Patent No.: US 6,481,707 B2
(45) Date of Patent: Nov. 19, 2002

(54) PAPER-FEEDING ROLLER

(75) Inventors: Toshiro Matsuo, Kobe (JP); Hideyuki Okuyama, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/906,689

(22) Filed: Jul. 18, 2001

(65) Prior Publication Data

US 2002/0145247 A1 Oct. 10, 2002

(30) Foreign Application Priority Data

Jan. 29, 2001 (JP) ..... 2001-020311

(51) Int. Cl.[7] ..... B65H 3/06
(52) U.S. Cl. ..... 271/109; 492/57; 492/59
(58) Field of Search ..... 399/279; 271/169, 271/314; 492/56, 57, 59

(56) References Cited

U.S. PATENT DOCUMENTS 6,127,031 A 10/2000 Fukumoto
6,273,415 B1 * 8/2001 Tengo et al. ..... 271/109

FOREIGN PATENT DOCUMENTS

| | | |
|---|---|---|
| JP | 08099732 | 4/1996 |
| JP | 10-279115 | 4/1997 |
| JP | 10299762 | 11/1998 |

* cited by examiner

*Primary Examiner*—H. Grant Skaggs

(57) ABSTRACT

A paper-feeding roller, made of a cylindrical elastic material, which is used for a printing apparatus of ink jet type, with the paper-feeding roller mounted on a core, wherein a friction coefficient ($\mu$) of the paper-feeding roller is set not less than 1.5; and the following relationship is established among the friction coefficient ($\mu$) of the paper-feeding roller, a tensile elongation E (%) thereof, and a fracture-time strength T (MPa) thereof:

$$15>(E\times T)/(\mu\times 100)\geqq 5.$$

9 Claims, 3 Drawing Sheets

PAPER-FEEDING ROLLER

FIELD OF THE INVENTION

The present invention relates to a paper-feeding roller. Particularly, the present invention relates to a paper-feeding roller for use in a paper-feeding mechanism of a printing apparatus, a color facsimile, and the like.

More particularly, the present invention relates to a paper-feeding roller which can be preferably used in a printing apparatus of ink jet type and has improved wear resistance when it rubs against a separation pad at the time of exhaustion of paper.

DESCRIPTION OF THE RELATED ART

The paper-feeding roller is used in a paper-feeding mechanism of an office appliance such as the printer, the color facsimile, a copying machine, an ATM, and the like. Normally, EPDM (ethylene-propylene-diene copolymer), natural rubber, urethane rubber, chloroprene rubber, polynorbornane, and the like are used for the paper-feeding roller. Because the paper-feeding roller is used to feed paper, a film, and the like, the paper-feeding roller is required to have a high friction coefficient to allow it to have a high paper-feeding force. The paper-feeding roller is also required to have a superior wear resistance to withstand continuous paper-feeding.

Various proposals have been made to provide a paper-feeding roller having a high friction coefficient and a superior wear resistance. For example, the paper-feeding roller proposed in Japanese Patent Application No.9-88048 is composed of rubber having a low loss tangent (elastic hysteresis loss: tan δ) to reduce its hardness to thereby restrain the paper-feeding roller from slipping on paper and improve its wear resistance.

In recent years, household printers and facsimiles have come into popular use. Because these printing apparatuses are for personal users, they are required to be inexpensive. Thus, as a printing method, ink jet type is normally adopted for the household printing apparatuses.

In the paper-feeding mechanism of the ink jet type printing apparatus, when printing paper in a paper-feeding tray unit is exhausted, the paper-feeding roller is forcibly idled over a separation pad. The exhaustion of the printing paper is detected by the idling of the paper-feeding roller. The detection method eliminates the need for providing the paper-feeding mechanism with a member for detecting the exhaustion of the printing paper. Thus, the detection method has an advantage of reducing the cost of the printing apparatus of ink jet type.

However, in the printing apparatus of ink jet type, when the paper-feeding roller idles, the paper-feeding roller rubs against the separation pad and is worn.

The inventor of the above-described paper-feeding roller paid attention to the restraining of the paper-feeding roller from slipping on the paper to improve its friction coefficient and wear resistance. Thus, the paper-feeding mechanism of the ink jet type printing apparatus cannot prevent the paper-feeding roller from being worn strongly owing to rubbing of the paper-feeding roller against the separation pad.

That is, in improving the wear resistance of the paper-feeding roller, the inventor has not paid attention to the fact that the paper-feeding roller is forcibly idled with the paper-feeding roller rubbing against the separation pad. Therefore, the paper-feeding roller does not have a sufficient wear resistance.

Consequently, when the conventional paper-feeding roller is adopted in the ink jet type printing apparatus, the paper-feeding roller is worn strongly because the paper-feeding roller rubs more strongly against the separation pad than against paper.

When the wear resistance is insufficient, powder generated when the paper-feeding roller is worn attaches the surface of the paper-feeding roller and the powder attaches to paper in subsequent printing. When the powder attaches to the paper, an image formation is difficult and the powder separates from the paper after an image is formed thereon to form a blank portion on the formed image.

SUMMARY OF THE INVENTION

The present invention has been made in view of the problem. Thus, it is an object of the present invention to provide a paper-feeding roller having superior wear resistance and not generating powder when the paper-feeding roller rubs against a separation pad.

To achieve the object, the present invention provides a paper-feeding roller, made of a cylindrical elastic material, with the paper-feeding roller mounted on a core. A friction coefficient ($\mu$) of the paper-feeding roller is set not less than 1.5. The friction coefficient ($\mu$) of the paper-feeding roller, a tensile elongation E (%) thereof, and a fracture-time strength T (MPa) thereof are set to the following relationship:

$$15>(E\times T)/(\mu\times 100)\geqq 5$$

The reason friction coefficient ($\mu$) of the paper-feeding roller is set not less than 1.5 is because if the friction coefficient ($\mu$) is less than 1.5, in an ink jet type printing apparatus in which various types of paper are fed, there occurs a situation in which the paper-feeding roller cannot feed paper because of its insufficient paper-feeding force.

According to the present invention, each of the tensile elongation (E) of the paper-feeding roller and its fracture-time strength (T) is set high. The friction coefficient ($\mu$) of the paper-feeding roller is also set high so that a value $P=(E\times T)/(\mu\times 100)$ (MPa) is set not less than 5 nor more than 15.

Because the value P is set not less than 5 nor more than 15, the paper-feeding roller maintains a high friction coefficient, has improved wear resistance, hardly generates powder when it rubs against a separation pad, and does not delay feeding paper because it has a high paper-feeding force. That is, if the value P is less than five, the tensile elongation (E) of the paper-feeding roller and its fracture-time strength (T) become low, and a breaking strength (E×T) which is an index of its wear resistance becomes also low, and its wear resistance deteriorates because its friction coefficient becomes high.

If the value P is less than 15, its compression permanent set becomes high and its paper-feeding force becomes low.

Supposing that the breaking strength (tensile elongation (E)×fracture-time strength (T)) is low and that the friction coefficient of the paper-feeding roller used for the printing apparatus of ink jet type is low, the amount of powder generated by abnormal abrasion is small and the generated powder hardly attaches to paper during idling of the paper-feeding roller. Thus, printing is not adversely affected by the paper-feeding roller.

However, if the friction coefficient of the paper-feeding roller is less than 1.5, the paper-feeding roller has an insufficient paper-feeding force, as described above. Thus, the value P is set to the above-described range by setting its friction coefficient and the breaking strength (E×T) high.

From the above-described standpoint, the tensile elongation E (%) is favorably in the range of 100 to 800 and more favorably in the range of 150 to 700. The fracture-time strength T is favorably in the range of 1.5 to 8.0 and more favorably in the range 2.5 to 5.0. The breaking strength expressed by (E)×(T) is favorably in the range of 800 to 2000 and more favorably in the range of 800 to 1500. The friction coefficient ($\mu$) is favorably in the range of 1.5 to 3.5 and more favorably in the range of 1.5 to 3.0.

In the case where the paper-feeding roller is used for an ink jet type printing apparatus, the friction coefficient ($\mu$) of the paper-feeding roller is set to the range of 1.5 to 3.5. In the case where the paper-feeding roller is used for a printing apparatus not of the ink jet type, the friction coefficient ($\mu$) thereof is set to the range of 2.0 to 3.0.

It is preferable that the elastic material of the paper-feeding roller is composed of a thermoplastic elastomer composition. In this case, it is easy to adjust the value P to the above-described range.

Preferably, a diene-containing polymer is dynamically cross-linked with a resin-cross-linking agent, with the diene-containing polymer being mixed with a thermoplastic elastomer to form the elastic material of a composition containing a matrix consisting of the thermoplastic elastomer and the cross-linked diene-containing polymer dispersed in the form of particles in the matrix.

As the diene-containing polymer which is dispersed in the form of particle, EPDM, natural rubber, acrylonitrile-butadiene rubber, styrene-butadiene rubber, and polynorbornene can be used. The weatherable EPDM is most favorable of these polymers.

As the thermoplastic elastomer which forms the matrix, it is possible to use styrene thermoplastic elastomer, olefin thermoplastic elastomer, urethane thermoplastic elastomer, ester thermoplastic elastomer, and amide thermoplastic elastomer. These thermoplastic elastomers are used independently or as a mixture of two of them. The styrene thermoplastic elastomer and the olefin thermoplastic elastomer (for example, propylene thermoplastic elastomer) are most favorable of these thermoplastic elastomers, because the paper-feeding roller containing these two thermoplastic elastomers has a low hardness and compression permanent set.

Hydrogenated styrene thermoplastic elastomer is most favorable of the styrene thermoplastic elastomers. Because an intermediate block of the hydrogenated styrene thermoplastic elastomer is hydrogenated, the double bond disappears and thus the hydrogenated styrene thermoplastic elastomer is not cross-linked during the dynamic cross-linking. Therefore, it is easy to plasticize the thermoplastic elastomer composition after the dynamic cross-linking is performed. As the hydrogenated styrene thermoplastic elastomer, it is possible to use styrene-butadiene-styrene copolymer (SBS), styrene-isoprene-styrene copolymer (SIS), styrene-ethylene-styrene copolymer (SES), styrene-ethylene/propylene-styrene copolymer (SEPS), and styrene-ethylene/butadiene-styrene copolymer (SEBS). The olefin thermoplastic elastomer does not have a double bond either. Thus, it is easy to plasticize a thermoplastic elastomer composition containing the olefin thermoplastic elastomer.

Instead of these thermoplastic elastomers or in combination therewith, the following thermoplastic resins can be used as the thermoplastic polymers forming the matrix: chlorinated polyethylene, polyvinyl chloride, polyolefin, polyurethane, polyester, polyester-polyether, polyamide, ionomer resin, EEA resin, and ethylene-vinyl acetate copolymer.

As the thermoplastic elastomer forming the matrix, it is preferable to use a substance having a comparatively high molecular weight to easily set the parameter P of the paper-feeding roller to the above-described range.

It is preferable to use the styrene-ethylene/propylene-styrene copolymer (SEPS) having a molecular weight of favorably not less than 200000 and more favorably not less than 300000. It is also preferable to mix polypropylene (PP) having a comparatively high molecular weight with the styrene-ethylene/propylene-styrene copolymer (SEPS).

It is preferable that the weight ratio of the thermoplastic elastomer to the diene-containing polymer is not less than 3/7 nor more than 6/4. If the weight ratio is less than the lower limit, it is difficult for the thermoplastic elastomer to be present as the matrix. Thus, processability such as extrusion and pelletizing becomes poor. If the weight ratio is more than the upper limit, the rubber component becomes less. Thus, it is difficult to impart desired flexibility to the paper-feeding roller.

As the thermoplastic elastomer which forms the matrix, the styrene-ethylene/propylene-styrene copolymer (SEPS) having a molecular weight of not less than 200000 is mixed with the polypropylene (PP) at a ratio of 2:1 to 4:1. The thermoplastic elastomer consisting of the SEPS and the PP and the diene-containing polymer consisting of the EPDM are mixed with each other at a ratio of 3:7 to 6:4. Oil is mixed with a thermoplastic elastomer composition consisting of the SEPS, the PP, and the EPDM at a ratio of 1.5:1 to 2:1.

As the resin-cross-linking agent, a substance consisting of a halogenated addition condensation resin is used or a mixture of an addition condensation resin and a halogenating substance is used.

That is, after the reaction in which the dynamic cross-linking occurs, a by-product is hardly generated from the diene-containing polymer. Thus, the diene-containing polymer is preferably used as the resin-cross-linking agent. In particular, the substance consisting of the halogenated addition condensation resin is used or the mixture of the addition condensation resin and the halogenating substance is used as the resin-cross-linking agent, because these substances activate the cross-linking and allow the characteristic value P to be set to the above-described range easily.

The halogenating substance may be metal halide or resin halide. As the metal halide, it is possible to use tin chloride such as stannic chloride, iron chloride such as ferric chloride, cupric chloride such as copper chloride. As the resin halide, chlorinated polyethylene and the like can be used. These halogenating substances can be used independently or as a mixture of two or more thereof.

Favorably, the resin-cross-linking agent contains halogenated alkylphenol formaldehyde resin. It is favorable to add 15–3 parts by weight of the halogenated alkylphenol formaldehyde resin and more favorable to add 10–5 parts by weight thereof to 100 parts by weight of the diene-containing elastomer.

Most favorably, the resin-cross-linking agent contains the halogenated alkylphenol formaldehyde resin and alkylphenol formaldehyde resin mixed therewith at the ratio of 35:100 to optimize the cross-linking.

DETAILED DESCRIPTION OF THE PREFERRED EMBODIMENTS

The embodiments of the present invention will be described below with reference to drawings.

Figure 1:
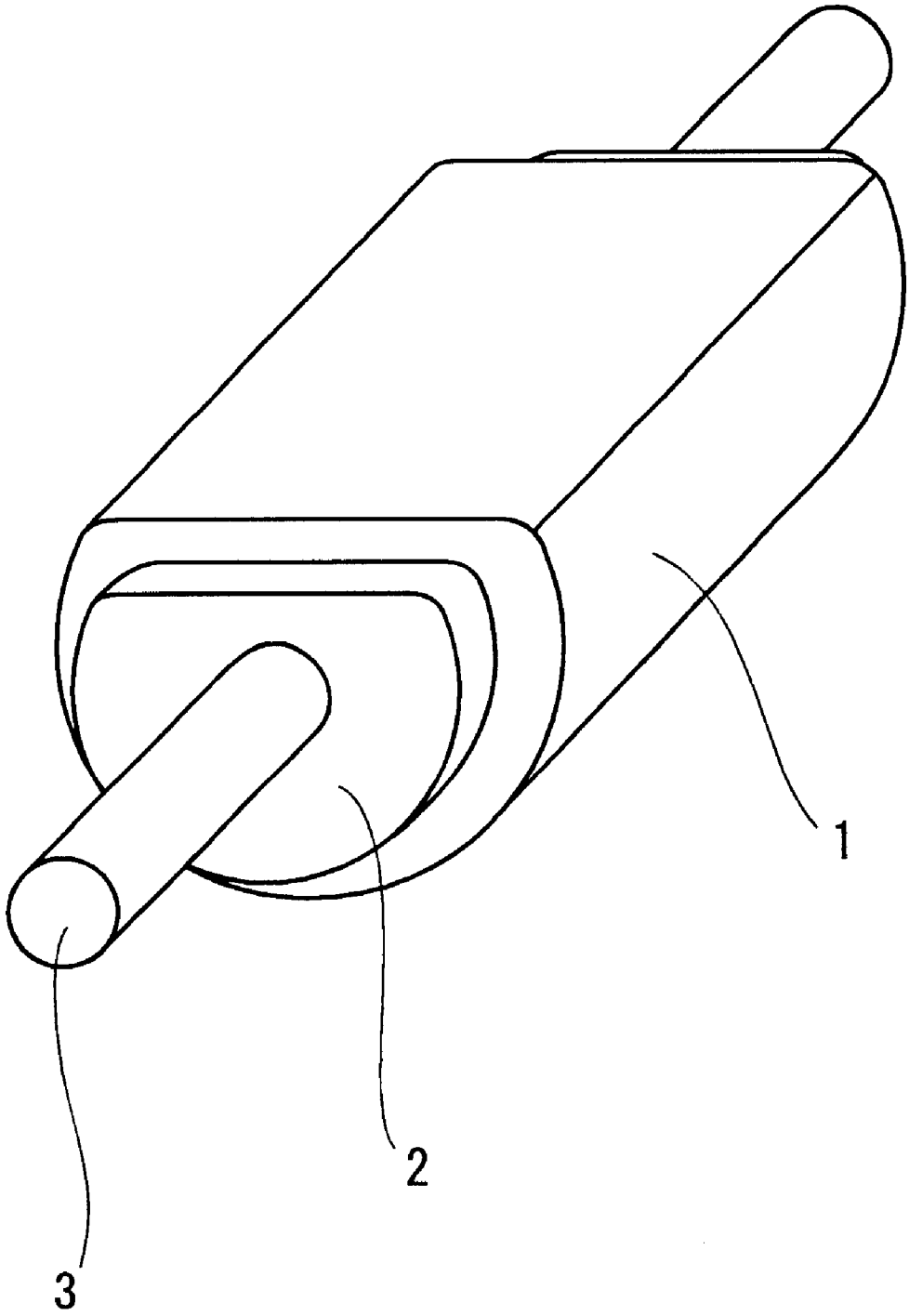
FIG. 1 is a perspective view showing a paper-feeding roller according to an embodiment of the present invention, together with a core and a rotary shaft.

FIG. 1 is a perspective view showing a paper-feeding roller 1 according to an embodiment of the present invention, together with a core 2 and a rotary shaft 3. The paper-feeding roller 1 is fixed to the core 2 by press fit thereof into the paper-feeding roller 1 or by bonding both to each other with an adhesive agent.

The paper-feeding roller 1 is formed of an elastic material made of a thermoplastic elastomer composition. More specifically, a diene-containing polymer is dynamically cross-linked with a resin-cross-linking agent, with the diene-containing polymer being mixed with a thermoplastic elastomer to form the thermoplastic elastomer composition containing a matrix consisting of the thermoplastic elastomer and the cross-linked diene-containing polymer dispersed in the form of particles in the matrix.

More specifically, to form the thermoplastic elastomer forming the matrix, a hydrogenated styrene thermoplastic elastomer consisting of styrene-ethylene/propylene-styrene copolymer (SEPS) having a comparatively large molecular weight of more than 200000 is mixed with an olefin thermoplastic elastomer consisting of polypropylene (PP) having a comparatively large molecular weight at the ratio of 37:13.

EPDM is used as the diene-containing polymer. The EPDM is mixed with the thermoplastic elastomer consisting of the mixture of the SEPS and the PP at the ratio of 1:1.

The resin-cross-linking agent contains halogenated alkylphenol formaldehyde resin. Six parts by weight of the resin-cross-linking agent is added to the other components of the thermoplastic elastomer composition.

Oil serving as a softening agent is mixed with the thermoplastic elastomer composition consisting of the SEPS, PP, and the EPDM at the ratio of the 1.5:1–2:1.

The friction coefficient ($\mu$) of the paper-feeding roller made of the elastic material is set not less than 1.5. The following relationship is established among the friction coefficient ($\mu$) of the paper-feeding roller, a tensile elongation E (%) thereof, and a fracture-time strength T (MPa) thereof:

$$15>(E\times T)/(\mu\times 100)\geqq 5 \quad (1)$$

Supposing that $P=(E\times T)/(\mu\times 100)$, it is more favorable to set the value P to the following range:

$$10>P\geqq 5.5$$

The breaking elongation E (%) of the paper-feeding roller 1 is measured by a tensile test in conformity to JIS-K6251. More specifically, by using an equation (2) shown below, the breaking elongation E (%) is computed from a distance L0 between initial marked lines and a distance L1 between the marked lines after the paper-feeding roller 1 is cut.

$$E=((L1-L0)/L0)\times 100 \quad (2)$$

The tensile strength T (Mpa) is measured by the tensile test in conformity to JIS-K6251. More specifically, the tensile strength T (Mpa) is computed from a maximum tensile force f (N) and the sectional area ($mm^2$) of a specimen by using an equation (3) shown below.

$$T=f/A \quad (3)$$

In the tensile test for measuring the breaking elongation (%) and the tensile strength T (MPa), a dumbbell specimen of size 4 is used. The stress rate is set to 500 mm/min. The specimen is obtained by punching it from the paper-feeding roller 1 in such a way that the longitudinal direction of the specimen is coincident with the rotational direction of the paper-feeding roller 1.

The friction coefficient ($\mu$) of the equation (1) is computed as follows: To obtain the frictional force of the specimen, the torque of the specimen is measured when printing is made, with three sheets of PPC paper set on a paper-feeding tray of an ink jet type printing apparatus and with a torque meter connected to the uppermost PPC paper. The frictional force of the specimen is divided by a spring load.

To compute the friction coefficient ($\mu$), the average of torque values measured fives times is computed.

The friction coefficient ($\mu$) of the paper-feeding roller 1 is set not less than 1.5, namely, larger than the friction coefficient ($\mu$) of the conventional paper-feeding roller. Because the parameter P is the quotient of the breaking strength (E×T) divided by the friction coefficient ($\mu$), the breaking strength (E×T) is also set to a large value.

When the friction coefficient ($\mu$) is set less than 1.5, the paper-feeding force of the paper-feeding roller 1 is so small that a defective paper feeding is likely to occur. Thus, the friction coefficient ($\mu$) is set not less than 1.5.

As described above, the value P is set to $15>P\geqq 5$ to allow the paper-feeding roller 1 to have a high friction coefficient as well as a high paper-feeding force. Thus, supposing that it is applied to the paper-feeding mechanism of the ink jet type printing apparatus, it is possible to restrain the paper-feeding roller 1 from being worn even though the paper-feeding roller 1 rubs against a separation pad strongly when paper in the paper-feeding tray is exhausted.

EXAMPLE 1

The paper-feeding roller of the example 1 was prepared by molding a thermoplastic elastomer composition consisting of 37 parts by weight of a styrene-ethylene/propylene-styrene copolymer (SEPS), 13 parts by weight of polypropylene (PP), 50 parts by weight of EPDM, 200 parts by weight of oil, and 6 parts by weight of halogenated alkylphenol formaldehyde resin.

As the SEPS, Septon 4077 produced by Kuraray Corp was used. As the PP, Novatec PP-BC6 manufactured by Japan Polychem Corp. was used. As the EPDM, EPDM 670 $\mu$ produced by Sumitomo Chemical Corp. was used. As the resin-cross-linking agent, only Tackirol 250III was used.

Each of the SEPS and the PP has a comparatively large molecular weight. The molecular weight of the SEPS consisting of the Septon 4077 is about 300000. The molecular weight of the PP consisting of the Novatec PP-BC6 is about 2.7 in melt flow rate.

EXAMPLE 2

The paper-feeding roller of the example 2 was prepared by molding a thermoplastic elastomer composition containing the same components as those of the thermoplastic elastomer composition of the example 1, except that two kinds of resin-cross-linking agents were used. The amount of each component of the thermoplastic elastomer composition of the example 2 was also equal to that of the corresponding component of the thermoplastic elastomer composition of the example 1, except the amount of each of the resin-cross-linking agents (total amount of resin-cross-linking agent of the example 1 was equal to that of resin-cross-linking agent of example 1). That is, as the resin-cross-linking agent, 1.5 parts by weight of the Tackirol 250III consisting of the halogenated alkylphenol formaldehyde resin and 4.5 parts by weight of Tackirol 201 consisting of alkylphenol formaldehyde resin were used to optimize the cross-linking.

EXAMPLE 3

The paper-feeding roller of the example 3 was prepared by molding a thermoplastic elastomer composition consisting of 37 parts by weight of the styrene-ethylene/propylene-styrene copolymer (SEPS), 13 parts by weight of the polypropylene, 50 parts by weight of the EPDM, 200 parts by weight of the oil. The cross-linking was optimized as in the case of the example 2 by using 1.5 parts by weight of the Tackirol 250III consisting of the halogenated alkylphenol formaldehyde resin and 4.5 parts by weight of the Tackirol 201 consisting of the alkylphenol formaldehyde resin.

As the SEPS and the PP, Septon CJ-001 produced by Kuraray Corp. was used. The Septon CJ-001 is formed by mixing Septon 4055 and Atactic PP at the ratio of 100:35. As the EPDM, the EPDM 670 $\mu$ produced by Sumitomo Chemical Corp. was used.

The molecular weight of the Septon 4055 is about 200000. The molecular weight of the Attack-chick PP is in the range of 500 to 1000 in melt flow rate. The molecular weight of the SEPS and that of the PP are smaller than that of the example 1 but larger than a middle molecular weight of the SEPS and that of the PP. That is, the molecular weight of the Septon 4055 is in the range of 50000 to 300000. The middle molecular weight of the Septon 4055 is about 100000. Thus, 200000 which is the molecular weight of the Septon 4055 of the example 3 is comparatively large.

EXAMPLE 4

The paper-feeding roller of the example 4 was prepared by molding a thermoplastic elastomer composition consisting of 37 parts by weight of the styrene-ethylene/propylene-styrene copolymer (SEPS), 13 parts by weight of the polypropylene (PP), 50 parts by weight of the EPDM, 200 parts by weight of the oil. The cross-linking was optimized as in the case of the example 2 by using 1.5 parts by weight of the Tackirol 250III consisting of the halogenated alkylphenol formaldehyde resin and 4.5 parts by weight of the Tackirol 201 consisting of the alkylphenol formaldehyde resin.

As the SEPS, the polymeric Septon 4077, produced by Kuraray Corp, having a high molecular weight was also used as in the case of the example 1. As the PP, MG05BS manufactured by Japan Polychem Corp. was used. As the EPDM, EPDM 670 $\mu$ produced by Sumitomo Chemical Corp. was used.

As in the case of the example 1, the molecular weight of the SEPS was high. The molecular weight of the PP consisting of the MG05BS was about 45 in melt flow rate lower than that of the PP of the example 1 but was middle.

EXAMPLE 5

The paper-feeding roller of the example 5 was prepared by molding a thermoplastic elastomer composition consisting of 37 parts by weight of the styrene-ethylene/propylene-styrene copolymer (SEPS), 13 parts by weight of the polypropylene (PP), 50 parts by weight of the EPDM, 150 parts by weight of the oil. The cross-linking was not optimized by using six parts by weight of the Tackirol 250III consisting of the halogenated alkylphenol formaldehyde resin used in the example 1. As the SEPS and the PP, the Septon CJ-001 produced by Kuraray Corp. was used as in the case of the example 3. As the EPDM, the EPDM 670 $\mu$ produced by Sumitomo Chemical Corp. was used.

COMPARISON EXAMPLE 1

The paper-feeding roller of the comparison example 1 was prepared by molding a thermoplastic elastomer composition containing the same components as those of the thermoplastic elastomer composition of the example 3. Each of the SEPS and the PP had a lower molecular weight than that of the example 1. The cross-linking was not optimized by using six parts by weight of the Tackirol 250III consisting of the halogenated alkylphenol formaldehyde resin, as in the case of the example 1.

COMPARISON EXAMPLE 2

The paper-feeding roller of the comparison example 2 was prepared by molding a thermoplastic elastomer composition containing the same components as those of the thermoplastic elastomer composition of the example 4. The molecular weight of the SEPS was high equally to the SEPS of the example 1. The molecular weight of the PP was lower than that of the PP of the example 1. As in the case of the example 1, the cross-linking was not optimized by using six parts by weight of the Tackirol 250III consisting of the halogenated alkylphenol formaldehyde resin.

COMPARISON EXAMPLE 3

The paper-feeding roller of the comparison example 3 was prepared by molding a thermoplastic elastomer composition consisting of 37 parts by weight of the styrene-ethylene/propylene-styrene copolymer (SEPS), 13 parts by weight of the polyesterpolyether, 50 parts by weight of the EPDM, 200 parts by weight of the oil. As in the case of the example 1, the cross-linking was not optimized by using six parts by weight of the Tackirol 250III consisting of the halogenated alkylphenol formaldehyde resin.

As the SEPS, Septon 4077, having a high molecular weight, produced by Kuraray Corp. was used as in the case of the example 1. Instead of the PP, 35481 produced by Toray Dupont Corp. was used. As the EPDM, the EPDM 670 $\mu$ produced by Sumitomo Chemical Corp. was used.

Tables 1 and 2 show the above-described compositions of the examples 1 through 5 and the comparison examples 1 through 3 and the parts by weight thereof.

TABLE 1

| | Composition | Parts by weight |
|---|---|---|
| E1 | Septon 4077/PP(BC6)/EPDM670 $\mu$/oil | 37/13/50/200 |
| E2 | Septon 4077/PP(BC6)/EPDM670 $\mu$/oil<br>Amount and kind of resin-cross-linking agent were different from those of E1 for optimum cross-linking | 37/13/50/200 |
| E3 | Septon CJ-001/EPDM670 $\mu$/oil<br>Amount and kind of resin-cross-linking agent used were same as those of E2 to optimize cross-linking | 50/50/200 |
| E4 | Septon 4077/PP(MG05BS)/EPDM670 $\mu$/oil<br>Amount and kind of resin-cross-linking agent used were same as those of E2 to optimize cross-linking | 37/13/50/200 |
| E5 | Septon CJ-001/EPDM670 $\mu$/oil | 50/50/150 |
| C1 | Septon CJ-001/EPDM670 $\mu$/oil | 50/50/200 |
| C2 | Septon 4077/PP(MG05BS)/EPDM670 $\mu$/oil | 37/13/50/200 |
| C3 | Septon 4055/35481 of Toray Dupont/EPDM670 $\mu$/oil | 37/13/50/200 |

Where E denotes example, and Cdenotes comparison example.

TABLE 2

| | Molecular weight (comparison relative to that of E1) | | Optimization of cross-linking |
|---|---|---|---|
| E1 | SEPS (high) | PP (high) | Undone |
| E2 | SEPS (high) | PP (high) | Done |
| E3 | SEPS (low) | PP (low) | Done |
| E4 | SEPS (high) | PP (middle) | Done |
| E5 | SEPS (low) | PP (low) | Undone (Amount of oil was reduced to half) |
| C1 | SEPS (low) | PP (low) | Undone |
| C2 | SEPS (high) | PP (middle) | Undone |
| C3 | SEPS (low) | Polyester-polyether | Undone |

Where E denotes example, and C denotes comparison example.

As described above, "low" in table 2 means that the molecular weight is lower than that of the example 1 but higher than a middle molecular weight of the SEPS and the PP.

The tensile elongation, the fracture-time strength (T), and the friction coefficient ($\mu$) of the specimen of each of the examples 1–5 and the comparison examples 1–3 were measured to compute each value P, and the wear resistance of each specimen was also measured. The viscoelasticity of each specimen was also measured to compute the loss tangent (tan δ) thereof.

The results are as shown in table 3 below.

TABLE 3

| | Fracture-time strength T (MPa) | Tensile elongation E (%) | Friction coefficient ($\mu$) | Value P | Wear Resistance | Tanδ |
|---|---|---|---|---|---|---|
| E1 | 3.03 | 500 | 2.32 | 6.52 | ○ | 0.0927 |
| E2 | 3.67 | 615 | 2.26 | 9.97 | ○ | 0.0504 |
| E3 | 2.54 | 595 | 2.57 | 5.89 | ○ | 0.0825 |
| E4 | 2.59 | 690 | 2.95 | 6.06 | ○ | 0.0914 |
| E5 | 3.95 | 300 | 1.83 | 6.47 | ○ | 0.0678 |
| C1 | 2.68 | 320 | 2.50 | 3.43 | x | 0.0663 |
| C2 | 3.12 | 405 | 3.08 | 4.11 | x | 0.0658 |
| C3 | 1.94 | 405 | 2.82 | 2.78 | x | 0.0871 |

Where E denotes example, and C denotes comparison example.

[Method of Measuring Tensile Elongation (E) and Fracture-time Strength (T)]

Figure 2:
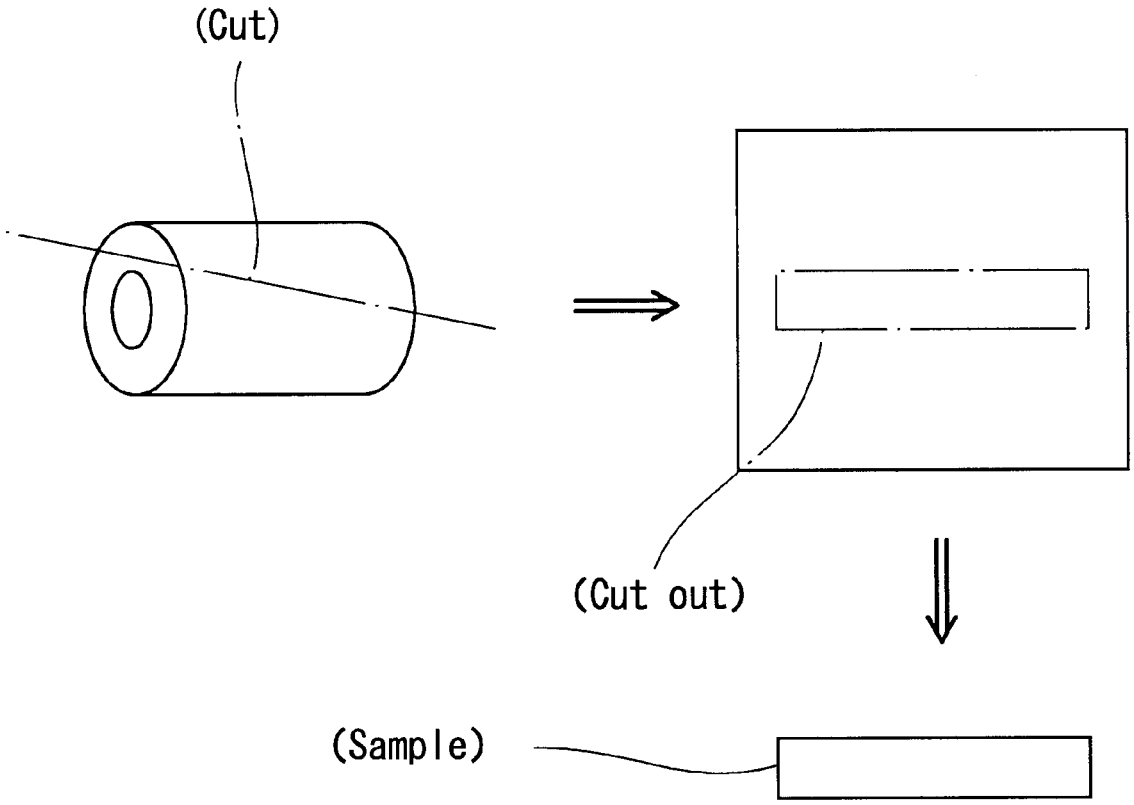
FIG. 2 is a schematic view showing a test method.

The tensile elongation (E) and fracture-time strength (T) were measured by the above-described method. That is, after the paper-feeding roller is cut, as shown with a one-dot chain line of FIG. 2, it was developed. Samples (length: 30 mm) were cut out longitudinally from the developed portion with a dumbbell specimen of size 4, as shown with a one-dot chain line of FIG. 2.

The tensile elongation (E) and the fracture-time strength (T) of each sample were measured by a tensile test in conformity to JIS-K6251. The initial elongation was 10%, and the deformation was +0.025%.

The viscoelasticity of each sample was also measured at +50° C. by using samples similar to those used to measure the tensile elongation (E) and the fracture-time strength (T).

[Method of Measuring Friction Coefficient ($\mu$)]

The friction coefficient (t) of each sample was measured by the above-described method. That is, with three sheets of paper ("glossy super-fine paper" manufactured by Seiko Epson Corp.) set on a paper-feeding tray of an ink jet type printer (manufactured by Canon Corp., BJ$\mu$600) and with a torque meter connected to the uppermost paper, a computer connected to the ink jet type printer issued a printing instruction to measure the paper-feeding force of each sample in a printing mode. The friction coefficient was computed by dividing the paper-feeding force by a spring load during the paper feeding.

Five paper-feeding rollers were prepared for each of the examples and the comparison examples. They were installed on the printer. The load of the spring mounted on the paper-feeding unit of the printer was measured in advance.

The friction coefficient was measured five times by exchanging paper-feeding rollers to take an average.

[Evaluation of Wear Resistance]

Similarly to the method of measuring the friction coefficient, the paper-feeding roller was installed on the ink jet type printer. The computer connected to the ink jet type printer issued a printing instruction, with paper in the paper-feeding tray exhausted to idle the paper-feeding roller. After this operation was repeated 40 times, paper ("glossy super-fine paper" manufactured by Seiko Epson Corp.) was passed through the paper-feeding roller to count the number of powders (rubber powder) which attached to the paper. The number of powders was measured for each of five paper-feeding rollers to take an average. The case in which the average was less than five is denoted as "o" and the case in which the average was more than five is denoted as "x".

Figure 3:
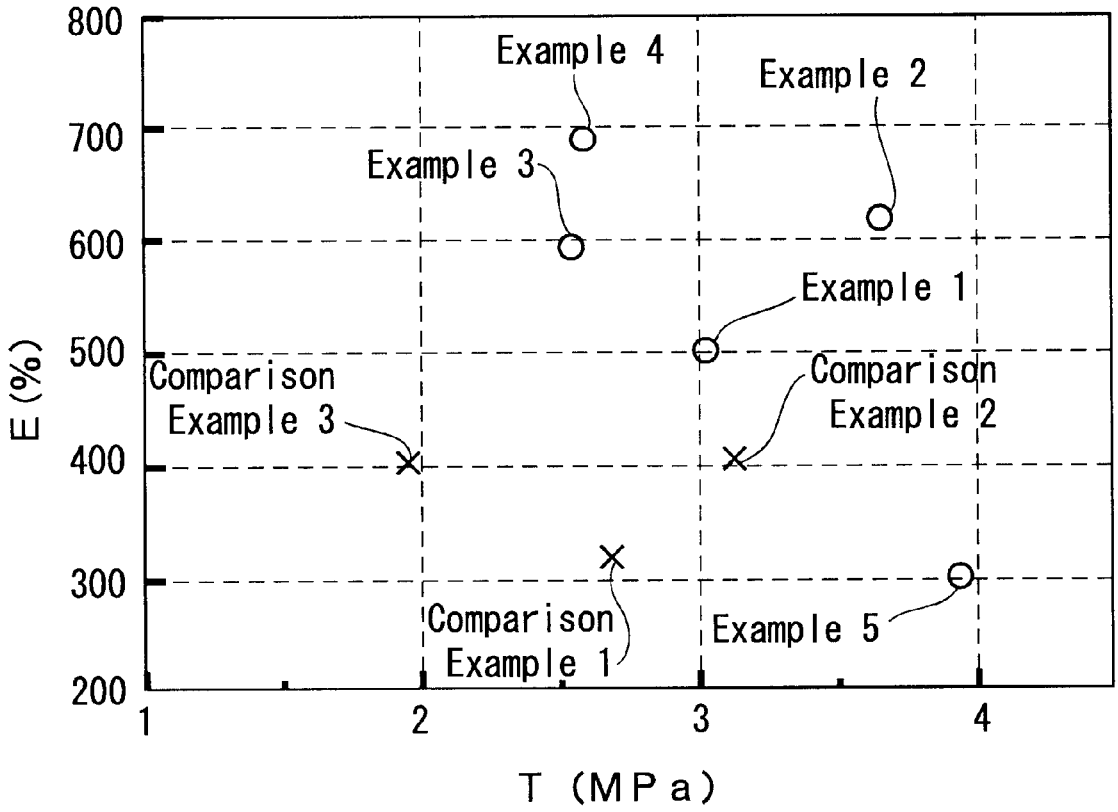
FIG. 3 is a graph showing evaluated results of wear resistances.

FIG. 3 is a graph showing evaluated results of the wear resistance of each of the examples 1 through 5 and the comparison examples 1 through 3.

As shown in table 3, the wear resistance of each of the examples 1 through 5 was evaluated as "o", whereas the wear resistance of each of the comparison examples 1 through 3 was evaluated as "x".

More specifically, the value P of the paper-feeding roller of the comparison example 1 was 3.43 which is less than 5. The paper-feeding roller had a high friction coefficient and a high paper-feeding force but had a low breaking strength and an inferior durability.

The value P of the paper-feeding roller of the comparison example 2 was 4.11 which is less than 5. Because the SEPS having a large molecular weight was used for the paper-feeding roller, it had a higher breaking strength and thus a higher durability than the comparison example 1. But the friction coefficient was too high with respect to the breaking strength. Thus, the paper-feeding roller had a problem in its durability.

The value P of the paper-feeding roller of the comparison example 3 was 2.78 which is less than 5. Because the paper-feeding roller contained polyester-polyether having a high cohesive force, instead of the PP, it had a higher tensile elongation than the comparison example 1. However, the paper-feeding roller had a low fracture-time strength and an inferior durability.

As against the comparison examples, the value P of the paper-feeding roller of the example 1 was 6.52. Because the paper-feeding roller contained the SEPS and the PP each having a high molecular weight, the paper-feeding roller was high in its friction coefficient and breaking strength (tensile elongation×fracture-time strength) and had improved wear resistance.

The paper-feeding roller of the example 2 contained the SEPS and the PP each having a high molecular weight. Further, the cross-linking was optimized. Therefore, the value P of 9.97 was largest of all the values P of the examples and the comparison examples. That is, the paper-feeding roller was improved in the highest extent.

Although the paper-feeding roller of the example 3 had the same components as those of the paper-feeding roller of the comparison example 1, the cross-linking was optimized. Therefore, the value P was 5.89 and the paper-feeding roller had a high breaking strength and a superior durability.

The SEPS and the PP of the paper-feeding roller of the example 4 had a molecular weight almost equal to that of the SEPS and the PP of the paper-feeding roller of the comparison example 2. However, the cross-linking was optimized. Therefore, the breaking strength was balanced well with the friction coefficient. The paper-feeding roller was 6.06 in the value P and superior in both the wear resistance and the paper-feeding force.

Although the paper-feeding roller of the example 5 had the same components as those of the paper-feeding roller of the comparison example 1, the amount of the oil used for the paper-feeding roller of the example 5 was reduced to half. Therefore, the paper-feeding roller had a high breaking strength and 6.47 in the value P. Thus, the paper-feeding roller had improved durability.

As described above and as shown in table 3 and FIG. 3, it can be confirmed that the paper-feeding roller of each comparison example having the value P less than five has inferior wear resistance, whereas the paper-feeding roller of each example having the value P more than five has superior wear resistance.

As apparent from the foregoing description, the paper-feeding roller of the present invention has superior wear resistance. Therefore, when the paper-feeding roller is forcibly idled, with paper in the paper-feeding tray exhausted and rubs against the separation pad, powder is hardly generated from the paper-feeding roller. Therefore, the use of the paper-feeding roller prevents a defective image and a blank portion from being formed on printing paper.

The present invention has the above-described operation and effect not only for the ink jet type-printing apparatus, but also for printing apparatuses such as a copying machine, a facsimile, and the like. But the present invention can be used more suitably for the ink jet type printing apparatus than for the other printing apparatuses.

What is claimed is:

1. A paper-feeding roller, made of a cylindrical elastic material, with said paper-feeding roller mounted on a core, wherein a friction coefficient ($\mu$) of said paper-feeding roller is set not less than 1.5; and the following relationship is established among said friction coefficient ($\mu$) of said paper-feeding roller, a tensile elongation E (%) thereof, and a fracture-time strength T (MPa) thereof:

$$15>(E\times T)/(\mu\times 100)\geqq 5.$$

2. The paper-feeding roller according to claim 1, wherein said tensile elongation E (%) is in the range of 100 to 800, said fracture-time strength T is in the range of 1.5 to 8.0, a breaking strength expressed by (E)×(T) is in the range of 800 to 2000, and said friction coefficient ($\mu$) is in the range of 1.5 to 3.5.

3. The paper-feeding roller according to claim 2, wherein in the case where said paper-feeding roller is used for an ink jet type printing apparatus, said friction coefficient ($\mu$) of said paper-feeding roller is set to the range of 1.5 to 3.5, wherein in the case where said paper-feeding roller is used for a printing apparatus not of said ink jet type, said friction coefficient ($\mu$) thereof is set to the range of 2.0 to 3.0.

4. The paper-feeding roller according to claim 1, wherein said elastic material consists of a thermoplastic elastomer composition.

5. The paper-feeding roller according to claim 4, wherein a diene-containing polymer is dynamically cross-linked with a resin-cross-linking agent, with said diene-containing polymer being mixed with a thermoplastic elastomer to form said elastic material of a composition containing a matrix consisting of said thermoplastic elastomer and said cross-linked diene-containing polymer dispersed in the form of particles in said matrix.

6. The paper-feeding roller according to claim 5, wherein said resin-cross-linking agent consists of a halogenated addition condensation resin; or an addition condensation resin and a halogenating substance.

7. The paper-feeding roller according to claim 5, wherein said resin-cross-linking agent contains halogenated alkylphenol formaldehyde resin.

8. The paper-feeding roller according to claim 5, wherein as a thermoplastic elastomer forming said matrix, a mixture of a hydrogenated styrene thermoplastic elastomer and an olefin thermoplastic elastomer is used; and as said diene-containing polymer, an ethylene-propylene-diene copolymer (EPDM) is used.

9. The paper-feeding roller according to claim 8, wherein as said thermoplastic elastomer which forms said matrix, a styrene-ethylene/propylene-styrene copolymer (SEPS) having a molecular weight of not less than 200000 and polypropylene (PP) are used, said SEPS and said PP are mixed with each other at a ratio of 2:1 to 4:1, said thermoplastic elastomer consisting of said SEPS and said PP and said diene-containing polymer consisting of said EPDM are mixed with each other at a ratio of 3:7 to 6:4, and oil is mixed with a thermoplastic elastomer composition consisting of said SEPS, said PP, and said EPDM at a ratio of 1.5:1 to 2:1.

* * * * *